US012790917B2

(12) United States Patent
Cappiello et al.

(10) Patent No.: US 12,790,917 B2
(45) Date of Patent: Nov. 10, 2026

(54) REDUCED-TRIP STIMULATION AND DEFLECTOR REMOVAL TOOL

(71) Applicant: Halliburton Energy Services, Inc., Houston, TX (US)

(72) Inventors: Stefano Cappiello, Spring, TX (US); Srinivasa Prasanna Vemuri, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/925,802

(22) Filed: Oct. 24, 2024

(65) Prior Publication Data

US 2025/0369313 A1 Dec. 4, 2025

Related U.S. Application Data

(60) Provisional application No. 63/656,000, filed on Jun. 4, 2024.

(51) Int. Cl.

| | |
|---|---|
| ***E21B 41/00*** | (2006.01) |
| ***E21B 17/20*** | (2006.01) |
| ***E21B 23/01*** | (2006.01) |

(52) U.S. Cl.

CPC ..... *E21B 41/0035* (2013.01); *E21B 17/20* (2013.01); *E21B 23/01* (2013.01); *E21B 2200/08* (2020.05)

(58) Field of Classification Search

CPC ..... E21B 17/20; E21B 2200/08; E21B 23/01; E21B 41/0035

See application file for complete search history.

(56) References Cited

U.S. PATENT DOCUMENTS

| | | | | |
|---|---|---|---|---|
| 5,353,876 | A * | 10/1994 | Curington | E21B 7/061 166/384 |
| 5,462,120 | A | 10/1995 | Gondouin | |
| 6,092,601 | A | 7/2000 | Gano et al. | |
| 6,668,932 | B2 | 12/2003 | Hess et al. | |

(Continued)

OTHER PUBLICATIONS

Fipke, et al., "The Use of Multilateral Well Designs for Improved Recovery in Heavy Oil Reservoirs", 2008 IADC/SPE Drilling Conference held in Orlando, Florida, U.S.A., Mar. 4-6, 2008, 2008, 11 pages.

(Continued)

*Primary Examiner* — Caroline N Butcher

(74) *Attorney, Agent, or Firm* — DeLizio, Peacock, Lewin and Guerra, LLP

(57) ABSTRACT

Implementations of a method, a system, and an apparatus are disclosed herein. In one implementation, a method comprises diverting, via a first diverter assembly, a coiled tubing system conveyed from a surface of a multibore well into a first lateral bore of a plurality of lateral bores of the multibore well, wherein the first diverter assembly is positioned within a primary bore of the multibore well. The method further includes removing, via the coiled tubing system, one or more isolation barriers positioned in the first lateral bore, positioning the coiled tubing system within the primary bore without removing the coiled tubing system from the multibore well to the surface, and removing, via the coiled tubing system, one or more isolation barriers positioned in the primary bore of the multibore well.

18 Claims, 15 Drawing Sheets

(56) References Cited

U.S. PATENT DOCUMENTS

| | | | | |
|---|---|---|---|---|
| 6,712,148 | B2 | 3/2004 | Fipke et al. | |
| 7,441,604 | B2 | 10/2008 | Green | |
| 10,352,140 | B2 | 7/2019 | Parlin et al. | |
| 10,435,993 | B2 | 10/2019 | Steele | |
| 11,414,930 | B2 | 8/2022 | Cho et al. | |
| 11,506,025 | B2 | 11/2022 | Hepburn et al. | |
| 2008/0105438 | A1* | 5/2008 | Jordan | C22C 28/00 166/117.6 |
| 2020/0256128 | A1* | 8/2020 | Cho | E21B 23/006 |
| 2021/0332658 | A1 | 10/2021 | Hepburn et al. | |

OTHER PUBLICATIONS

Mendes, et al., "Multilateral Wells in the Urucu Field of Western Brazil: Reducing Environmental Impact in the Amazon", SPE Annual Technical Conference and Exhibition held in New Orleans, Louisiana, USA, Sep. 30-Oct. 2, 2013., 2013, 12 pages.

Mendes, et al., "Successful Use of Multilateral Technology to Improve Oil Recovery in the Brazilian Amazon", SPE Latin American and Caribbean Petroleum Engineering Conference held in Maracaibo, Venezuela, May 21-23, 2014., 2014, 10 pages.

"PCT Application No. PCT/US24/54613 International Search Report and Written Opinion", Feb. 26, 2025, 11 pages.

* cited by examiner

100

Simulation for a bilateral (conventional method):

| Trip | Description | Rig / activity |
|---|---|---|
| - | Mainbore is fracked and isolated | Workover rig / fracking |
| 1 | Run workover whipstock for lateral access | Workover rig |
| 2 | Run Frac String | Workover rig |
| - | Stimulate lateral | Fracking |
| - | Isolate lateral | Coil tubing |
| 3 | Pull frac string | Workover rig |
| 4 | Run milling BHA on coil tubing. Mill out lateral barrier(s) | Coil tubing |
| 5 | Run workover whipstock retrieving tool, engage workover whipstock and POOH. | Coil tubing or WR |
| 6 | Run with milling BHA on coil tubing and mill out mainbore barrier | Coil tubing |
| Total trips for a bilateral | 6 dedicated runs<br>3 dedicated trips on workover rig<br>3 dedicated trip on coil tubing | |

FIG. 1

200

Simulation for a bilateral with new invention:

| Trip | Description | Rig / activity |
|---|---|---|
| - | Mainbore is fracked and isolated | Workover rig / fracking |
| 1 | Run Lateral Access Diverter (LAD) on frac string, release frac string and land it into lateral seal bore | Workover rig |
| - | Stimulate lateral | Fracking |
| - | Isolate lateral | Coil tubing |
| 2 | Pull frac string | Workover rig |
| 3 | Run milling BHA on coil tubing. Mill out lateral barrier(s) | Coil tubing |
| 3a | Pull milling BHA back into mainbore and mill out internal diverter | Coil tubing |
| 3b | Mill out mainbore barrier(s) | Coil tubing |
| Total trips for a bilateral | 3 dedicated runs<br>2 dedicated trips on workover rig<br>1 dedicated trip on coil tubing | |

FIG. 2

1300

Simulation for a Trilateral (conventional method):

| Trip | Description | Rig / activity |
|---|---|---|
| - | Mainbore is fracked and isolated | Workover rig / fracking |
| 1 | Run Workover Whipstock for lateral access | Workover rig |
| 2 | Run Frac String for lower lateral stimulation | Workover rig |
| - | Stimulate lower lateral | Fracking |
| - | Isolate lateral | Coil tubing |
| 3 | Pull frac string from lower lateral | Workover rig |
| 4 | Run workover whipstock for upper lateral access | Workover rig |
| 5 | Run frac string for upper lateral stimulation | Workover Rig |
| - | Stimulate upper lateral | Fracking |
| - | Isolate upper lateral | Coil tubing |
| 6 | Pull frac string from upper lateral | Workover rig |
| 7 | Run milling BHA on coil tubing and mill out barrier(s) from upper lateral. POOH. | Coil tubing |
| 8 | Run Workover Whipstock (WOW) retrieving tool, engage upper WOW and POOH. | Coil tubing or WR |
| 9 | Run milling BHA and mill out barrier(s) from lateral lower. POOH. | Coil tubing |
| 10 | Run WOW retrieving tool, engage lower main diverter and POOH. | Coil tubing or WR |
| 11 | Run milling BHA and mill out mainbore barrier(s). POOH. | Coil tubing |
| Total trips for a trilateral | 11 dedicated runs<br>6 dedicated trips on workover rig<br>5 dedicated trip on coil tubing | |

FIG. 13

1400

Simulation for a Trilateral with new invention:

| Trip | Description | Rig / activity |
|---|---|---|
| - | Mainbore is fracked and isolated | Workover rig / fracking |
| 1 | Run Lateral Access Diverter (LAD) on frac string, release frac string and land it into lateral seal bore | Workover rig |
| - | Stimulate lateral | Fracking |
| - | Isolate lateral | Coil tubing |
| 2 | Pull frac string | Workover rig |
| 3 | Run milling BHA on coil tubing. Mill out lateral barrier(s) | Coil tubing |
| 3a | Pull milling BHA back into mainbore and mill out internal diverter | Coil tubing |
| 3b | Slide over the next main diverter and mill our barrier(s) from lower lateral | Coil tubing |
| 3c | Pull milling BHA back into mainbore and mill out internal diverter | Coil tubing |
| 3d | Mill out mainbore barrier(s) | Coil tubing |
| Total trips for a trilateral | 3 dedicated runs<br>2 dedicated trips on workover rig<br>1 dedicated trip on coil tubing | |

FIG. 14

REDUCED-TRIP STIMULATION AND DEFLECTOR REMOVAL TOOL

TECHNICAL FIELD

The disclosure generally relates to downhole tools for use in a wellbore formed in one or more subsurface formations, and in particular, to stimulation techniques for multilateral (MLT) wells.

BACKGROUND

Multilateral wells, also referred to as multilaterals, MLTs, multibore wells, etc. may improve unconventional wells by increasing reservoir coverage without drilling multiple top sections of well (e.g., surface hole and intermediate wellbores). However, multilateral wells that require stimulation may be trip intensive. Multiple trips into and out of a well may induce extra operational costs and lost time.

BRIEF DESCRIPTION OF THE DRAWINGS

Implementations of the disclosure may be better understood by referencing the accompanying drawings.

FIG. 1 is a diagram depicting an example trip overview for a bilateral well using conventional techniques and equipment, according to some implementations.

FIG. 2 is a diagram depicting an example trip overview for a bilateral well using optimized techniques and equipment, according to some implementations.

FIG. 13 is an illustration depicting an example trip overview for a trilateral well using conventional techniques and equipment, according to some implementations.

FIG. 14 is an illustration depicting an example trip overview for a trilateral well using optimized techniques and equipment, according to some implementations.

FIGS. 1-15 and the operations described herein are examples meant to aid in understanding example implementations and should not be used to limit the potential implementations or limit the scope of the claims. None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

DESCRIPTION OF SOME EXAMPLE IMPLEMENTATIONS

Figure 3:
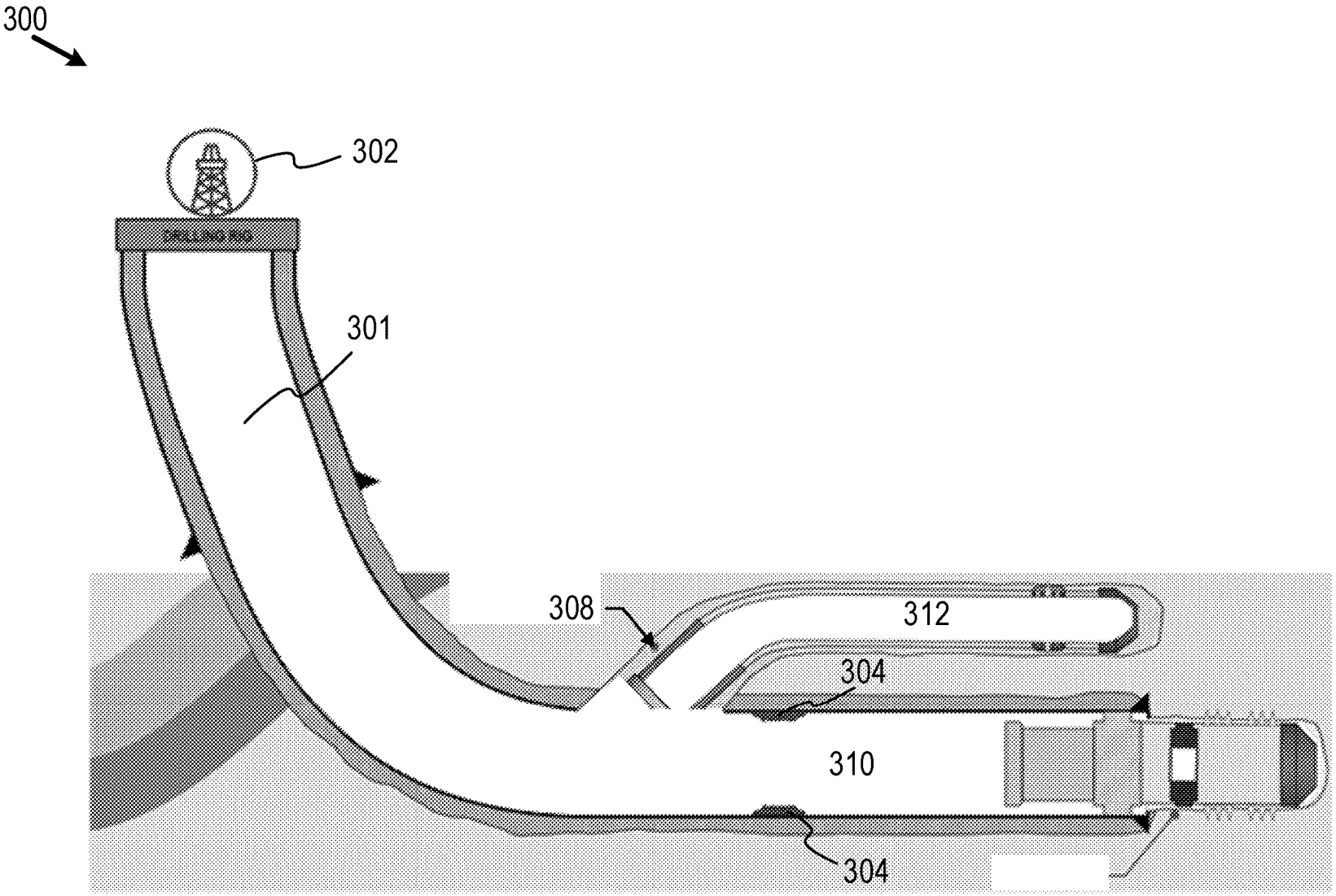
FIG. 3 is a first diagram of an example MLT well operation using the optimized technique, according to some implementations.

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

Overview

Therefore, a tool which may reduce the number of trips and aid in mitigating well control issues may be advantageous for use in multilateral wells. A reduced-trip stimulation and deflector removal tool may reduce the number of trips by combining the running of the frac string with the deployment of the diverter/deflector/whipstock. In addition, trips may be saved by removing/drilling one or more lateral access diverters (LAD). On the same trip, frac and isolation plugs may be pulled or milled out. This may mitigate well control issues, as all the plugs are removed in one trip in a controlled environment (coil tubing, BOP, etc.). For example, in a tri-lateral well configuration, up to 8 trips may be saved when compared to traditional tools and techniques.

Example implementations may enable the ability to run a diverter, whipstock, and/or a workover whipstock on a frac work string and/or junction isolation tool (JIT) prior to a hydraulic fracturing operation. Such a tool may have an internal profile to allow for an internal diverter to be installed. The diverter may be run together with the main assembly and may be comprised of a mill-able, a drillable material, a dissolvable material, etc. The internal diverter may also be run and retrieved on a dedicated trip using pipe, wireline or coil tubing.

A main assembly including a Lateral Access Diverter (LAD), also referred to as a main diverter, may support the lateral liner in multilateral applications to prevent the top of it from falling into the primary bore and act as a Junction Support Tool (JST). The main assembly may land into a dedicated latching profile previously installed as part of the casing/liner string or run on a dedicated trip (anchor packer).

In traditional multilateral applications where the primary bore and the lateral(s) are fracked, barriers may usually be milled or retrieved prior putting the well on production. However, an optimized technique, as described below, may allow for a milling BHA to be run across the Lateral Access Diverter (LAD) into the most upper lateral (furthest from the primary bore) in order to mill out any barriers or plugs within this upper lateral. The BHA (which is typically run on coil tubing) may then be pulled back into the primary bore. Rotation may be established through a downhole motor/device, and the internal diverter of the first LAD may be milled out. The BHA may then be run through the first LAD and further down across the next LAD and into the secondary lateral bore. The milling operations, which typically proceed from the furthest lateral from the primary bore and conclude with the primary bore, may be repeated for additional laterals. The steps to pick back up into the primary bore and to mill out the next internal diverter may also be repeated until all bores are treated and all plugs are milled and/or retrieved.

Operations may be repeated for any further lateral and for a bottom primary bore plug. Once all the barrier have been milled, the coiled tubing BHA may be retrieved to surface, leaving the LAD(s) downhole acting as junction support tools (as needed). The LAD(s) may also be used for any future lateral access. For example, new internal diverters may be run into the LADs, enabling deflection of a tool string into one or more of the lateral bores.

Example Bilateral Well Operations

Example trips of downhole equipment are now described with reference to traditional techniques and the improved technique. FIG. 1 is a diagram 100 depicting an example trip overview for a bilateral well using conventional techniques and equipment, according to some implementations. Prior to a first trip, a primary bore of a multilateral well may be fracked and isolated using a workover rig and fracking equipment. A workover whipstock may be conveyed into the well via the workover rig for lateral access during a first trip. In some implementations, the workover rig may utilize a work string comprised of a plurality of pipe joints to run equipment into the well. Some implementations may use traditional pipe joints, whereas other implementations may use coiled tubing. After placing the workover whipstock in the well, the work string may be pulled to the surface.

A frac string may be run into the well during a second trip using the workover rig. The frac string may be used to stimulate the lateral bore branching from the primary bore via fracking equipment. A coiled tubing unit may convey a plug into the lateral bore for isolation. For example, the lateral bore may require pressure and fluidic isolation from the rest of the well after a wellbore treatment operation has been performed in the lateral.

During a third trip, the frac string may be pulled from the well by the workover rig. A fourth tip may run a milling BHA on coil tubing to mill out one or more lateral barriers. A fifth trip may run a workover whipstock retrieval tool, engage with the workover whipstock, and pull the whipstock out of hole. This may be accomplished by coiled tubing or the workover rig. Lastly, a sixth trip may run into the well with the milling BHA on coiled tubing to mill out the primary bore barrier.

In total, this traditional technique to stimulate and complete a bilateral well may take 6 dedicated trips/runs. Three of the runs may use a workover rig, and three may use coiled tubing; swapping these systems at the surface also takes time. An optimized technique, as described in FIG. 2, may reduce the number of trips needed to complete the bilateral well.

FIG. 2 is a diagram 200 depicting an example trip overview for a bilateral well using optimized techniques and equipment, according to some implementations. Similar to FIG. 1, a primary bore of a bilateral MLT well may be fracked and isolated via a workover rig and frac equipment prior to a first trip. During the first trip, a lateral access diverter (LAD) may be run into the well on the frac string. The workover rig may be used to convey the LAD into the well. The frac string may be released and subsequently landed into the lateral seal bore. During the first trip, the lateral bore may be stimulated via frac equipment and then isolated using a plug conveyed via coiled tubing unit.

The frac string may be pulled during a second trip via the workover rig. On a third trip, the milling BHA may be run into the well via coiled tubing to mill out lateral barrier(s) in the lateral bore. On a different leg of the third trip (i.e., the work string has not returned to the surface), the milling BHA may be pulled back into the primary bore and used to mill out the internal diverter. This may be referred to as trip 3a. A second leg of the third trip, trip 3b, may utilize coiled tubing and the milling BHA to mill out primary bore barrier(s). Contrary to FIG. 1, the optimized technique and equipment described in FIG. 2 results in 3 dedicated trips/runs into the well: two are completed via a workover rig, and one is completed via coiled tubing.

A number of assumptions may be used when quantifying the number of trips used in FIGS. 1-2. For example, trips required to stimulate and isolate the primary bore may not be accounted for, as these should be the same for all scenarios (across both the conventional and optimized techniques). Trips required to stimulate and isolate the lateral(s) may not be accounted for as these should be the same for all scenarios(s). The conventional technique may include additional trips depending on what diverter is run into the well and if an additional internal diverter is run to gain access into the lateral with coiled tubing.

A step-by-step operation using the optimized technique of FIG. 2 is now described. FIGS. 3-12 are images of an example operation using the optimized technique for a bilateral well, according to some implementations. Many of the components described in FIGS. 4-12 may be similar to those described in FIG. 3.

FIG. 3 is a first diagram 300 of an example MLT well operation using the optimized technique, according to some implementations. The diagram 300 includes a drilling rig 302 used to drill a well 301. The well 301 may include a primary bore 310 and a lateral bore 312. The well 301 may include a junction where the lateral bore 312 and primary bore 310 meet. In some implementations, this may be a level 4 junction, although other junction types may be used. For example, the junction may instead be a level 2 junction. The lateral bore 312 may include a liner 308. The primary bore 310 may include at least one anchoring, orienting, and sealing device. For example, the primary bore 310 may include the anchoring, orienting, and sealing device 304.

In FIG. 3, the primary bore 310 and lateral bore 312 have been drilled and completed. The primary bore 310, lateral bore 312, junction, and liner 308 may be cemented in place. While a single lateral bore is depicted, multiple lateral bores (e.g., tri or quad-laterals) may be added via drilling. A tri-lateral configuration is described in FIGS. 13-14.

Figure 4:
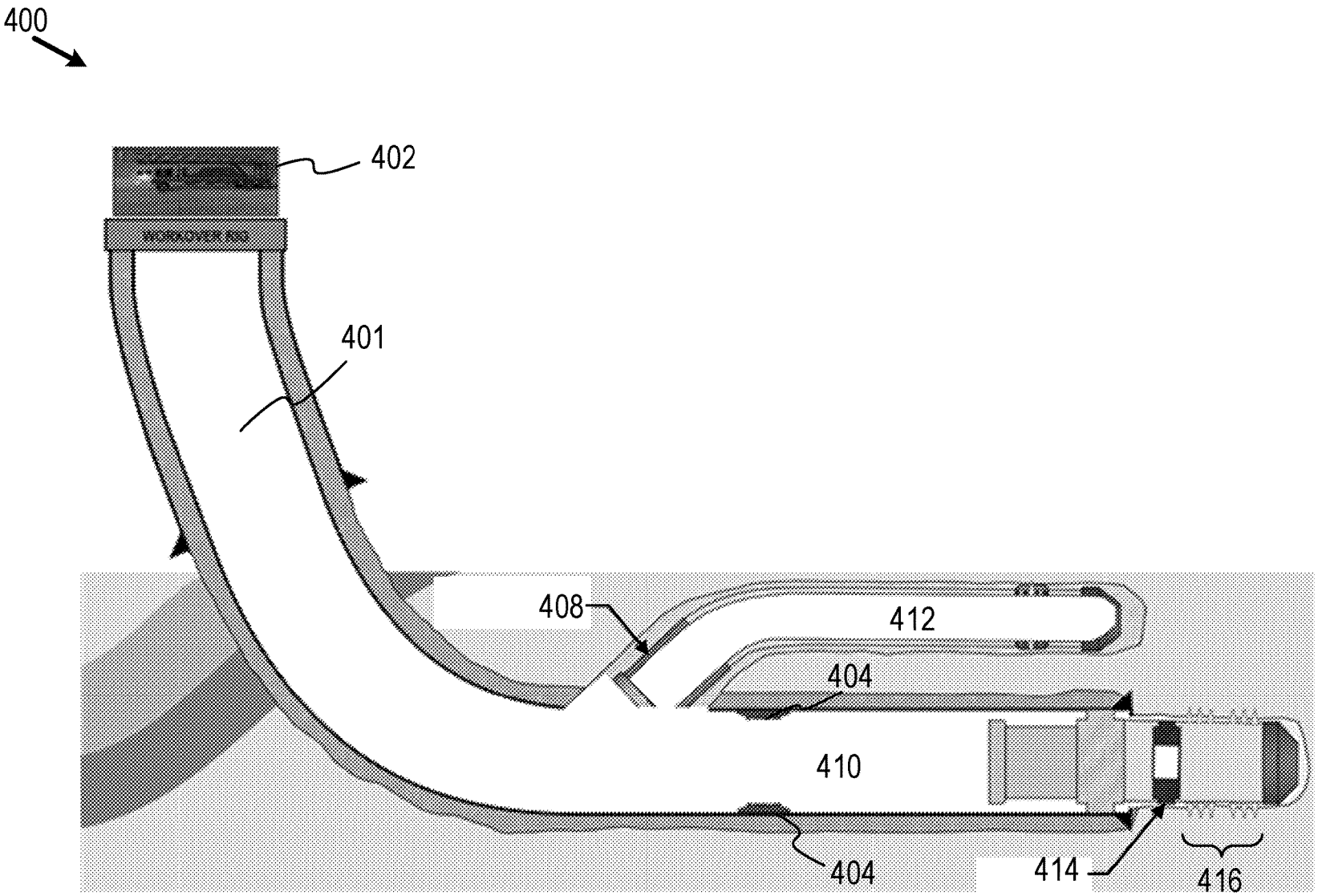
FIG. 4 is a second diagram of an example MLT well operation using the optimized technique, according to some implementations.

FIG. 4 is a second diagram 400 of an example MLT well operation using the optimized technique, according to some implementations. The diagram 400 includes a workover rig 402, a well 401, a liner 408, anchoring, orienting, and sealing device 404, a primary bore 410, a lateral bore 412, a primary bore barrier 414, and plurality of fractures 416. In FIG. 4, the primary bore 410 is fracked and isolated. For example, the primary bore barrier 414 may be set after generating and treating the plurality of fractures 416 in the primary bore 410. In some implementations, the primary bore barrier 414 may be a plug such as a bridge plug, although other implementations may be possible. After generating the fractures 416, a frac string, a junction isolation tool, etc. may be retrieved to the surface using the workover rig 402.

Figure 5:
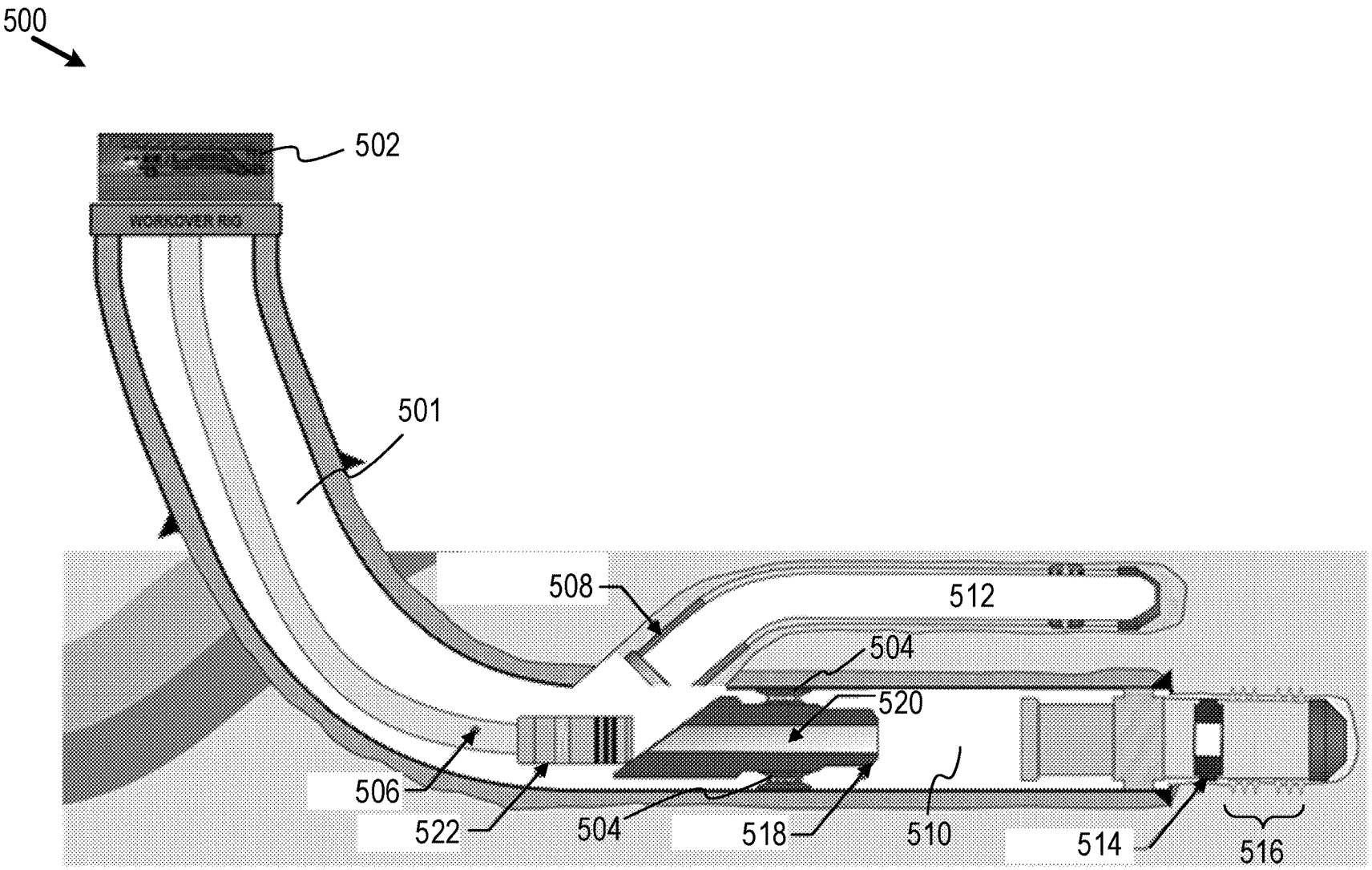
FIG. 5 is a third diagram of an example MLT well operation using the optimized technique, according to some implementations.

FIG. 5 is a third diagram 500 of an example MLT well operation using the optimized technique, according to some implementations. The diagram 500 includes a well 501, a workover rig 502, anchoring, orienting, and sealing device 504, a frac string 506, a liner 508, a primary bore 510, a lateral bore 512, a primary bore barrier 514, fractures 516, a main diverter 518, an internal diverter 520, and a seal stinger 522. The frac string 506 and seal stinger 522 may be used to run the main diverter 518 into the well 501. In some implementations, a junction isolation tool (JIT) may be used to run the main diverter 518 into the primary bore 510. The main diverter 518 may be landed into the anchoring, orienting, and sealing device 504 at depth. For example, the main diverter 518 may be landed into the anchoring, orienting, and sealing device 504 which may include one or more landing points, latching mechanisms, etc. The anchoring, orienting, and sealing device 504 may be used to anchor the main diverter 518 in the primary bore 510, orient the main diverter 518, and to provide a seal between the main diverter 518 and the casing of the primary bore 510. Orienting may, for example, include longitudinally rotating the main diverter 518 during installation. In some implementations, the anchoring, orienting, and sealing device 504 may be a ring shaped device configured to secure the main diverter 518 within the primary bore 510.

In addition to diverting work strings into the lateral bore 512, the main diverter 518, internal diverter 520, and the anchoring, orienting, and sealing device 504 may act as a plug that provides pressure and fluidic isolation of the primary bore 510 from the remainder of the well 501. Therefore, positioning the main diverter 518 and internal diverter 520 (which may together be referred to as a diverter assembly) within the primary bore 510 may plug and fluidically isolates the primary bore 510.

The main diverter 518 may be landed in the anchoring, orienting, and sealing device 504 by shearing one or more shear pins, through hydraulic activation, through mechanical setting, etc. In some implementations, an external orienting device including an orienting feature may assist in landing the main diverter within the anchoring, orienting, and sealing device 504. For example, the external orienting device may include an orienting feature such as a mule shoe to facilitate the orientation of the main diverter 518 within the primary bore 510. This external orienting device may also be used in other bores of the multibore well. Other means of landing the main diverter 518 may also be possible. Upon setting the main diverter 518, the frac string 506 or JIT may be lowered into the lateral seal bore. In some implementations, the frac string 506 may be comprised of one or more coiled tubing strings.

From the perspective of the frac string 506, the main diverter 518 may appear as an inclined or ramped face having a solid, circular portion within its area. The circular portion may be part of the internal diverter 520. The internal diverter 520 may be a solid, cylindrical device comprised of a drillable and/or mill-able material. For example, the internal diverter 520 may be comprised of aluminum, a composite material, magnesium, etc. Some implementations of the internal diverter 520 may be comprised of a dissolvable material. The internal diverter 520 may include a ramped end similar to the main diverter 518. However, other geometries and materials may be possible.

In some implementations, the main diverter 518 may include a sleeve extending into the junction formed by the lateral bore 512 and primary bore 510. The main diverter 518 and may support the liner 508 in multilateral applications to prevent the top of it from falling into the primary bore 510. Some implementations of the main diverter 518 and sleeve may act as a Junction Support Tool (JST).

Figure 6:
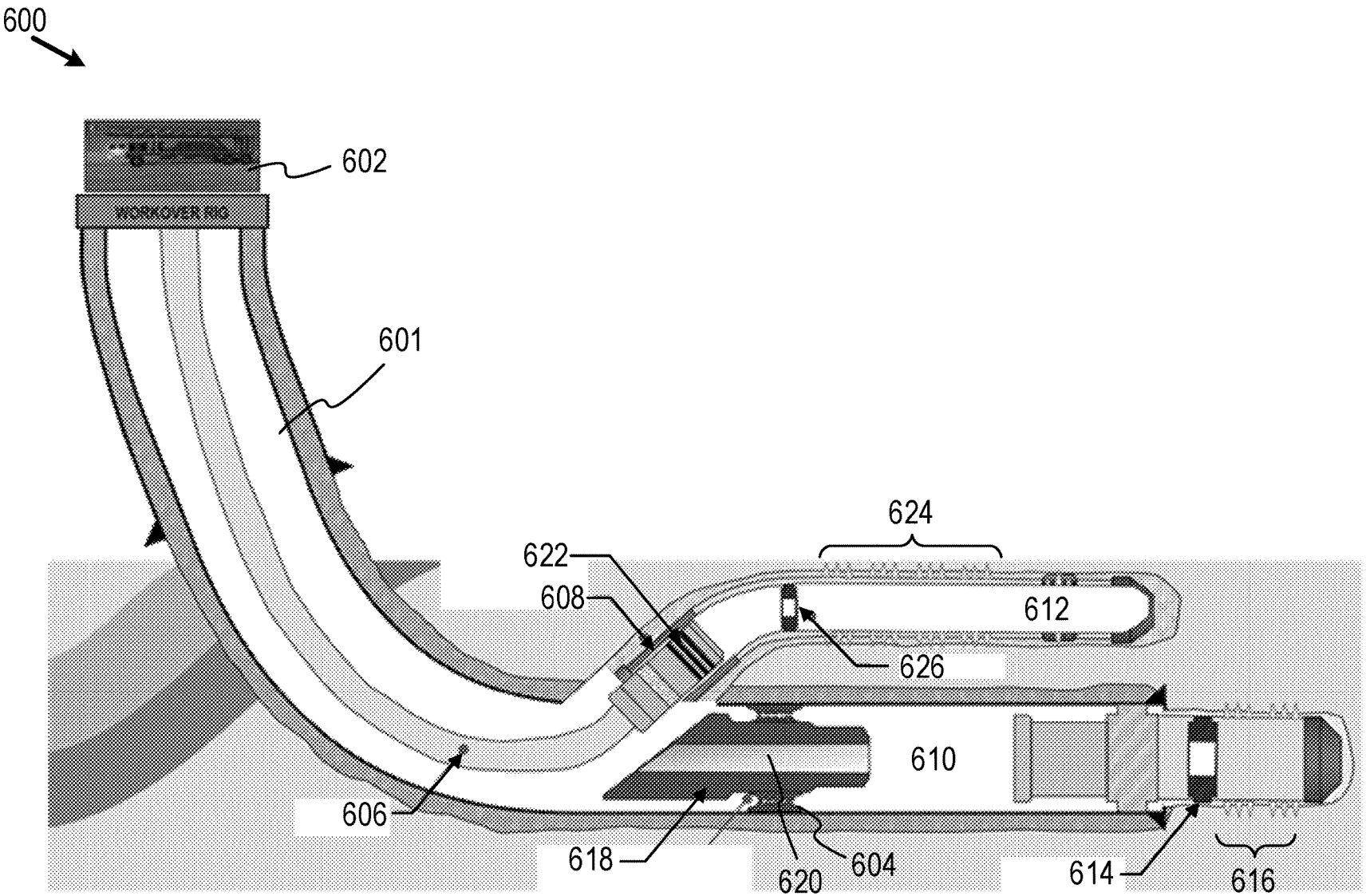
FIG. 6 is a fourth diagram of an example MLT well operation using the optimized technique, according to some implementations.

FIG. 6 is a fourth diagram 600 of an example MLT well operation using the optimized technique, according to some implementations. The diagram 600 includes a well 601, workover rig 602, anchoring, orienting, and sealing device 604, frac string 606, liner 608, primary bore 610, lateral bore 612, primary bore barrier 614, fractures 616, main diverter 618, internal diverter 620, seal stinger 622, fractures 624, and lateral bore barrier 626. Some implementations of the seal stinger 622 may include a ratch latch profile, although other configurations may be possible. After the seal stinger 522 of FIG. 5 is used to set the main diverter 518, the seal stinger 622 may pull back into the junction between the primary bore 610 and lateral bore 612 without being removed from the well 601. The ramped face of the main diverter 618 and internal diverter 620 may be used to land the frac string 606 into the lateral bore 612. The frac string 606 may be used to stimulate the lateral bore 612, forming a plurality of fractures 624. After generating the fractures 624, the lateral bore 612 may be isolated via the lateral bore barrier 626. The lateral bore barrier 626 may be conveyed into the well 601 with the diverters 618, 620 and the frac string 606. In some implementations, the lateral bore barrier 626 may be a bridge plug, although other devices may be used to isolate the lateral bore 612. The frac string 606 and/or a JIT may be retrieved by the workover rig 602 to the surface. This constitutes the first trip using the optimized technique of FIG. 2.

Figure 7:
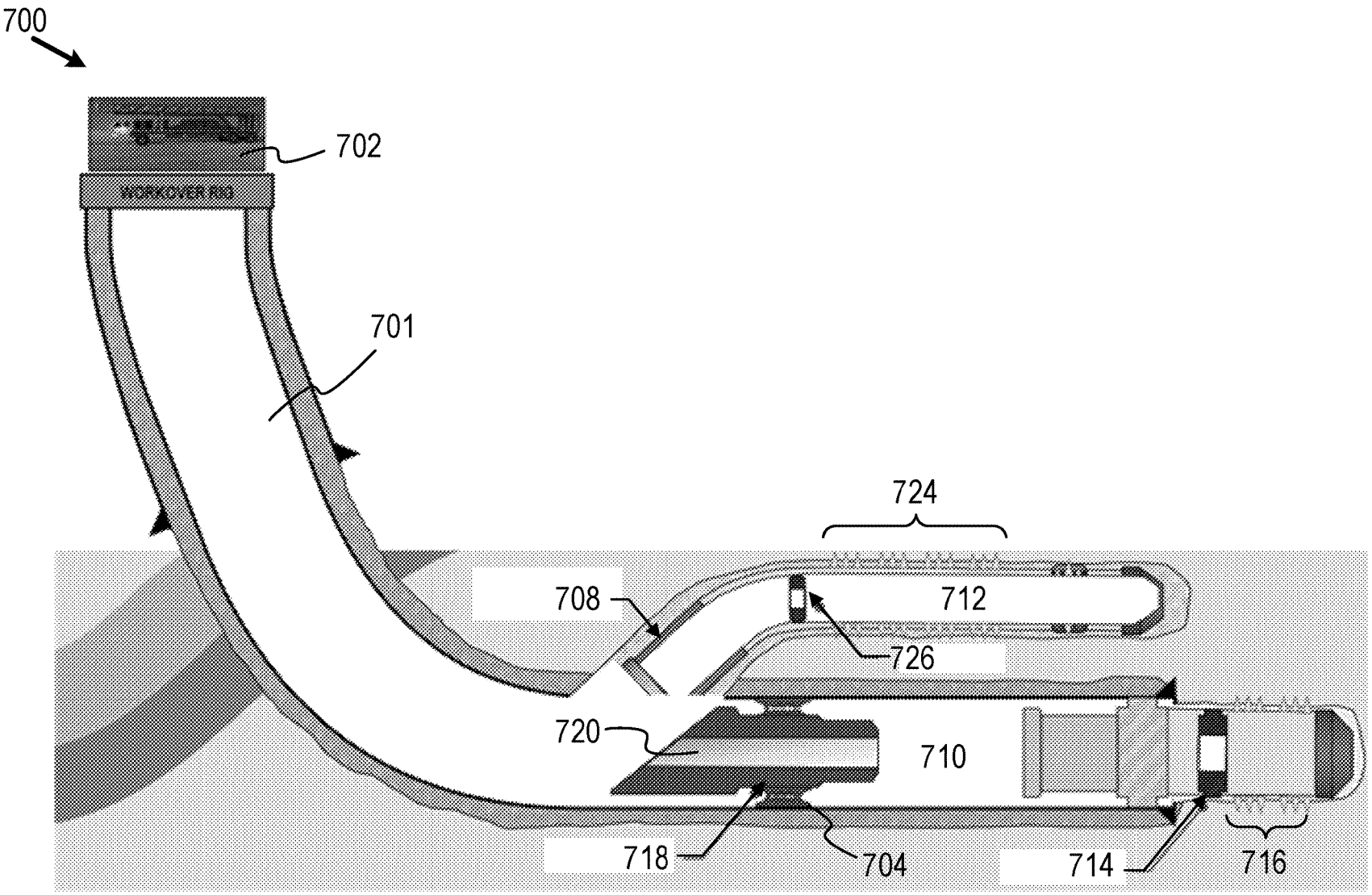
FIG. 7 is a fifth diagram of an example MLT well operation using the optimized technique, according to some implementations.

FIG. 7 is a fifth diagram 700 of an example MLT well operation using the optimized technique, according to some implementations. The diagram 700 includes a well 701, workover rig 702, anchoring, orienting, and sealing device 704, liner 708, primary bore 710, lateral bore 712, primary bore barrier 714, fractures 716, main diverter 718, internal diverter 720, fractures 724, and lateral bore barrier 726. FIG. 7 shows the well 701 after the frac string 606 of FIG. 6 has been tripped out of the well.

Additional laterals may be treated similar to the lateral bore 712. For example, an additional lateral bore may be included above the lateral bore 712 (tri-lateral MLT well), and a second main diverter 718 and internal diverter 720 may be installed in the lateral bore 712. The lateral bore 712 may include an anchoring, orienting, and sealing device configured to seat the second diverter(s). This main diverter and internal diverter may also be run on the frac string/JIT. To treat the additional lateral bore, a frac string may be conveyed into the well 701 and run on the main diverter 718 (and internal diverter 720). The diverters may act as a whipstock, guiding the frac string to the next bore. The frac string and/or JIT may similarly be lowered into the well 701 and ran against the second diverter(s) in the lateral bore 712 until the frac string reaches the secondary lateral (third) bore. Some implementations may also refer to this as the lateral seal bore. The secondary lateral may be fracked and isolated using a lateral bore barrier, and the frac string may be retrieved to the surface. This may be completed for any number of lateral bores branching from an MLT well, where all bores except the final lateral may include a main and internal diverter.

Figure 8:
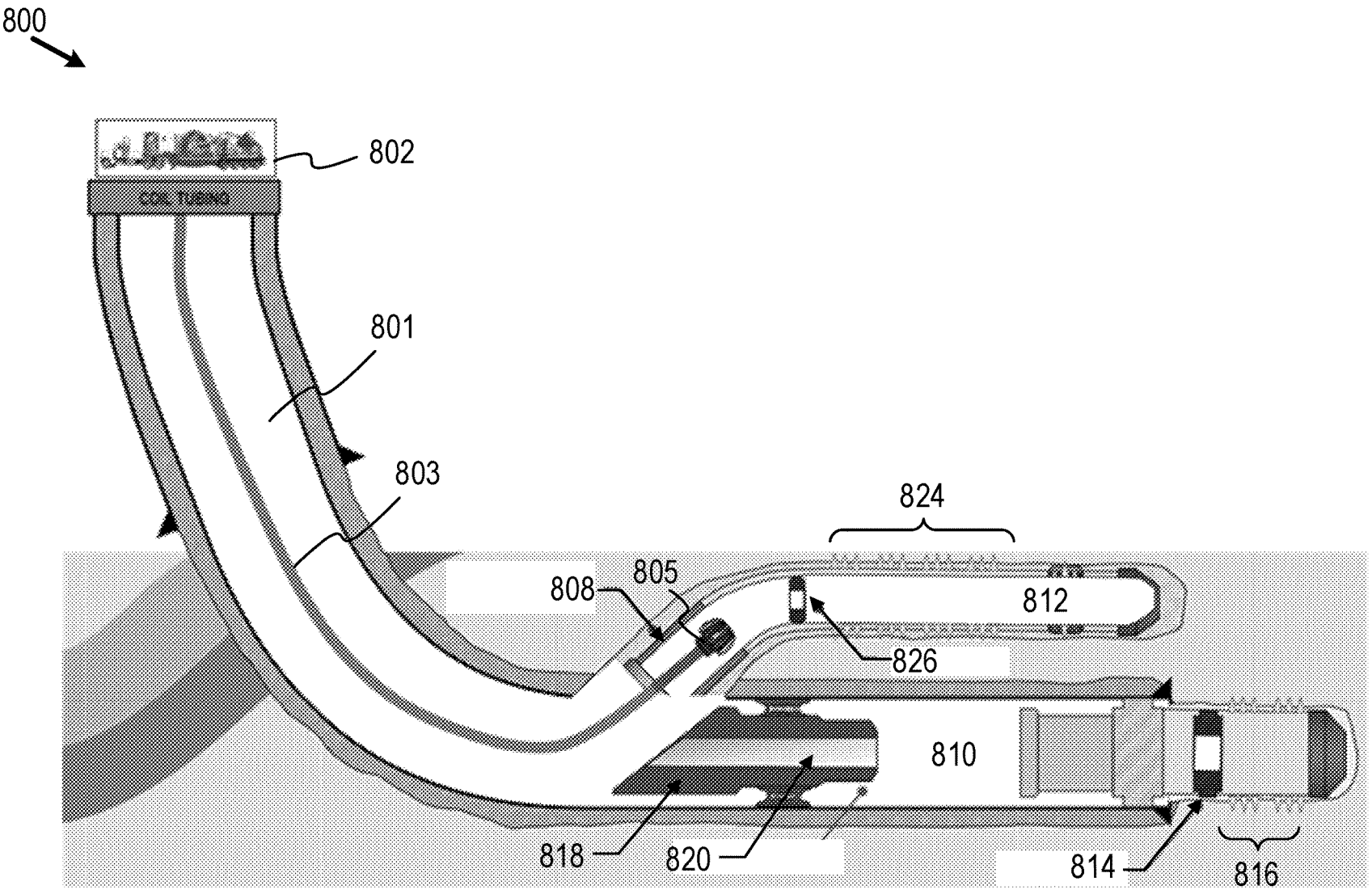
FIG. 8 is a sixth diagram of an example MLT well operation using the optimized technique, according to some implementations.

FIG. 8 is a sixth diagram 800 of an example MLT well operation using the optimized technique, according to some implementations. The diagram 800 includes a well 801, a coiled tubing unit 802, coiled tubing 803, anchoring, orienting, and scaling device 804, a milling bottomhole assembly (BHA) 805, a liner 808, primary bore 810, lateral bore 812, primary bore barrier 814, fractures 816, main diverter 818, internal diverter 820, fractures 824, and lateral bore barrier 826. The workover rig 702 of FIG. 7 may be swapped with the coiled tubing unit 802 to convey the milling BHA 805 into the well 801. The milling BHA 805 may be lowered into the well 801 without rotation. The milling BHA 805 may include a drill bit, a milling bit, etc. to mill out the lateral bore barrier 826. Additional plugs in the lateral well may be milled via the milling BHA 805. The milling BHA 805 and coiled tubing 803 may be run across the main diverter 818 and redirected into the lateral bore 812.

Figure 9:
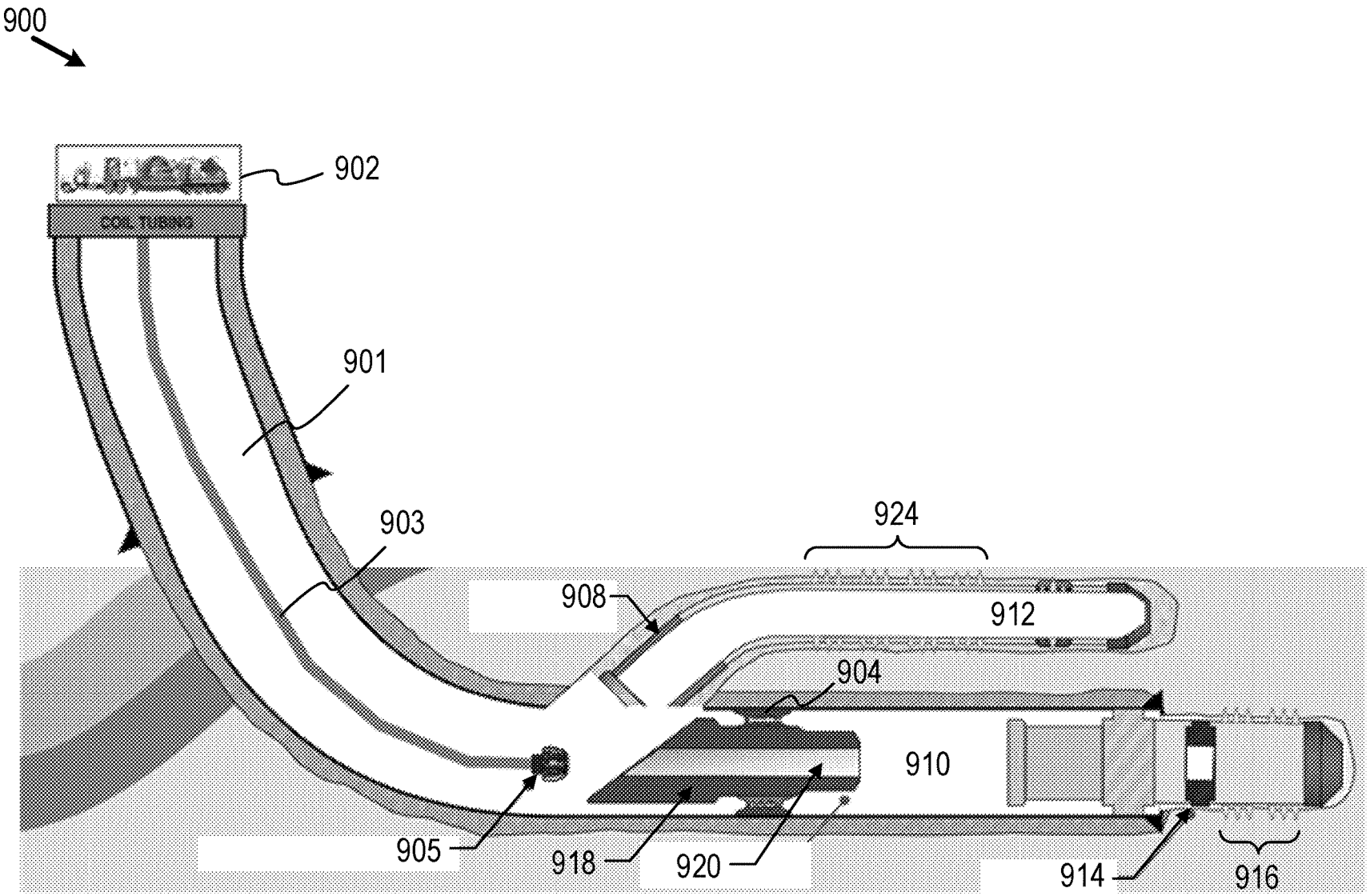
FIG. 9 is a seventh diagram of an example MLT well operation using the optimized technique, according to some implementations.

FIG. 9 is a seventh diagram 900 of an example MLT well operation using the optimized technique, according to some implementations. The diagram 900 includes a well 901, a coiled tubing unit 902, coiled tubing 903, anchoring, orienting, and sealing device 904, a milling BHA 905, a liner 908, a primary bore 910, lateral bore 912, primary bore barrier 914, fractures 916, main diverter 918, internal diverter 920, and fractures 924. In FIG. 9, all lateral barriers/plugs have been milled out from the lateral bore 912. After milling out all barriers in the lateral bore 912, the milling BHA 905 may be pulled back into the primary bore 910 via the coiled tubing 903. The milling BHA 905 may be aligned with the internal diverter 920 for milling.

Figure 10:
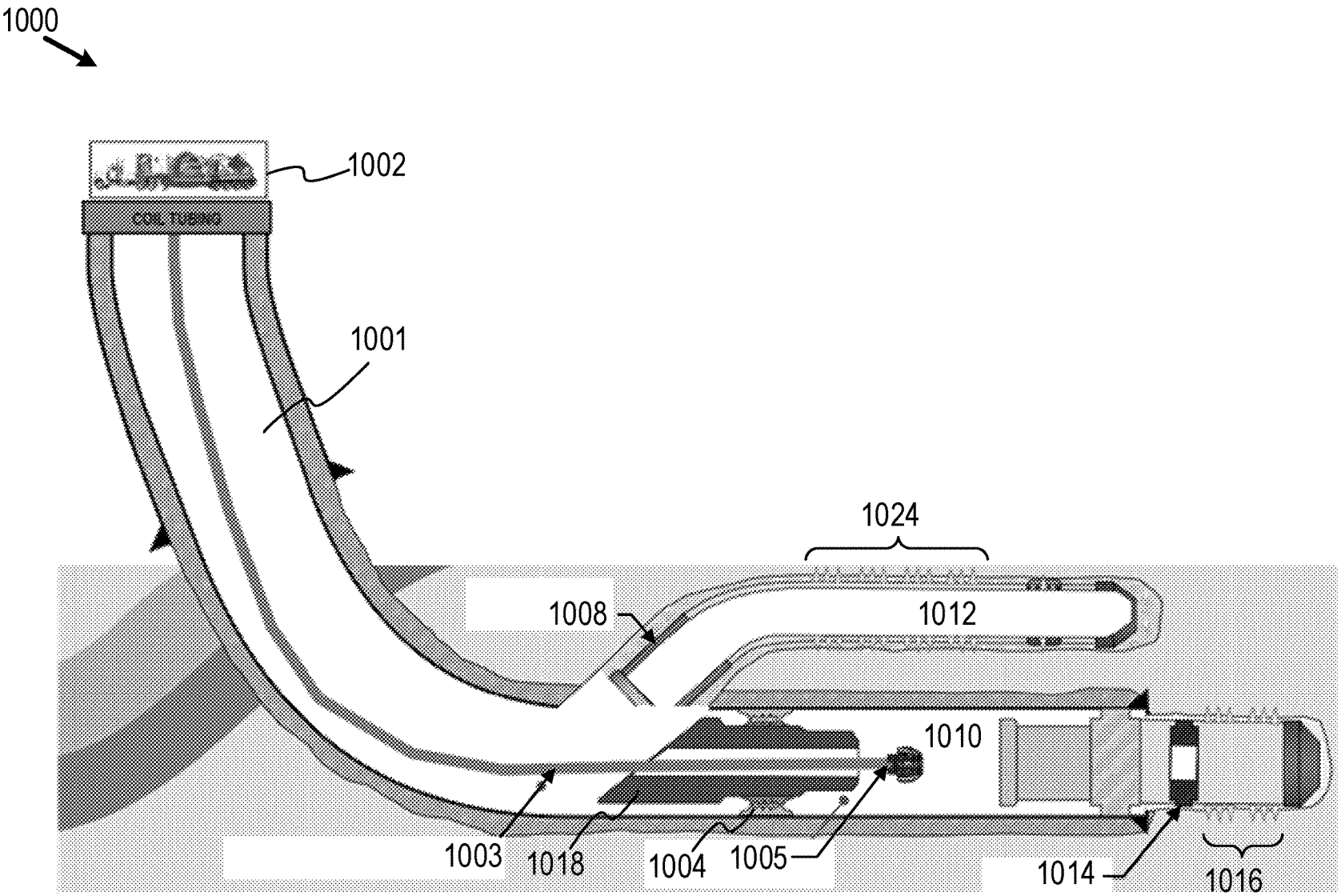
FIG. 10 is an eighth diagram of an example MLT well operation using the optimized technique, according to some implementations.

FIG. 10 is an eighth diagram 1000 of an example MLT well operation using the optimized technique, according to some implementations. The diagram 1000 includes a well 1001, a coiled tubing unit 1002, coiled tubing 1003, anchoring, orienting, and scaling device 1004, a milling BHA 1005, a liner 1008, a primary bore 1010, lateral bore 1012, primary bore barrier 1014, fractures 1016, main diverter 1018, and fractures 1024. In FIG. 10, the milling BHA 1005 is used to mill through the internal diverter 920 of FIG. 9. Downhole rotation of the milling BHA 1005 may be established via a downhole mud motor, an electric motor coupled with a battery system, an electric motor coupled with a power cable, etc. Other implementations may also be possible. The milling BHA 1005 may mill through the internal diverter which may be comprised of a material that is easier to mill/drill through than the main diverter 1018. For example, the internal diverter may be comprised of aluminum, a composite material, magnesium, a dissolvable material, ceramic, etc. Other materials may be used.

The milling of other internal diverters may be repeated for any additional laterals within the well 1001. For example, FIGS. 8-10 may be described with reference to a tri-lateral well configuration having an additional lateral bore above the lateral bore 1012. In this configuration, the milling BHA 905 may be slid over the uppermost LAD into the upper lateral bore. This may land the milling BHA into the second lateral bore above the lateral bore 912. Lateral barriers may be milled out in this second lateral, and the milling BHA 905 may then be pulled out of the second lateral and positioned back in the primary bore 910 and above the main diverter 918. The milling BHA 905 may be used to mill the internal diverter positioned within the main diverter 918. The milling BHA 905 may be run through the internal diverter and then across the next diverter into the second lateral. The main diverter 918 and any additional lateral access diverters may remain in the well 901 after their respective internal diverters have been milled.

Figure 11:
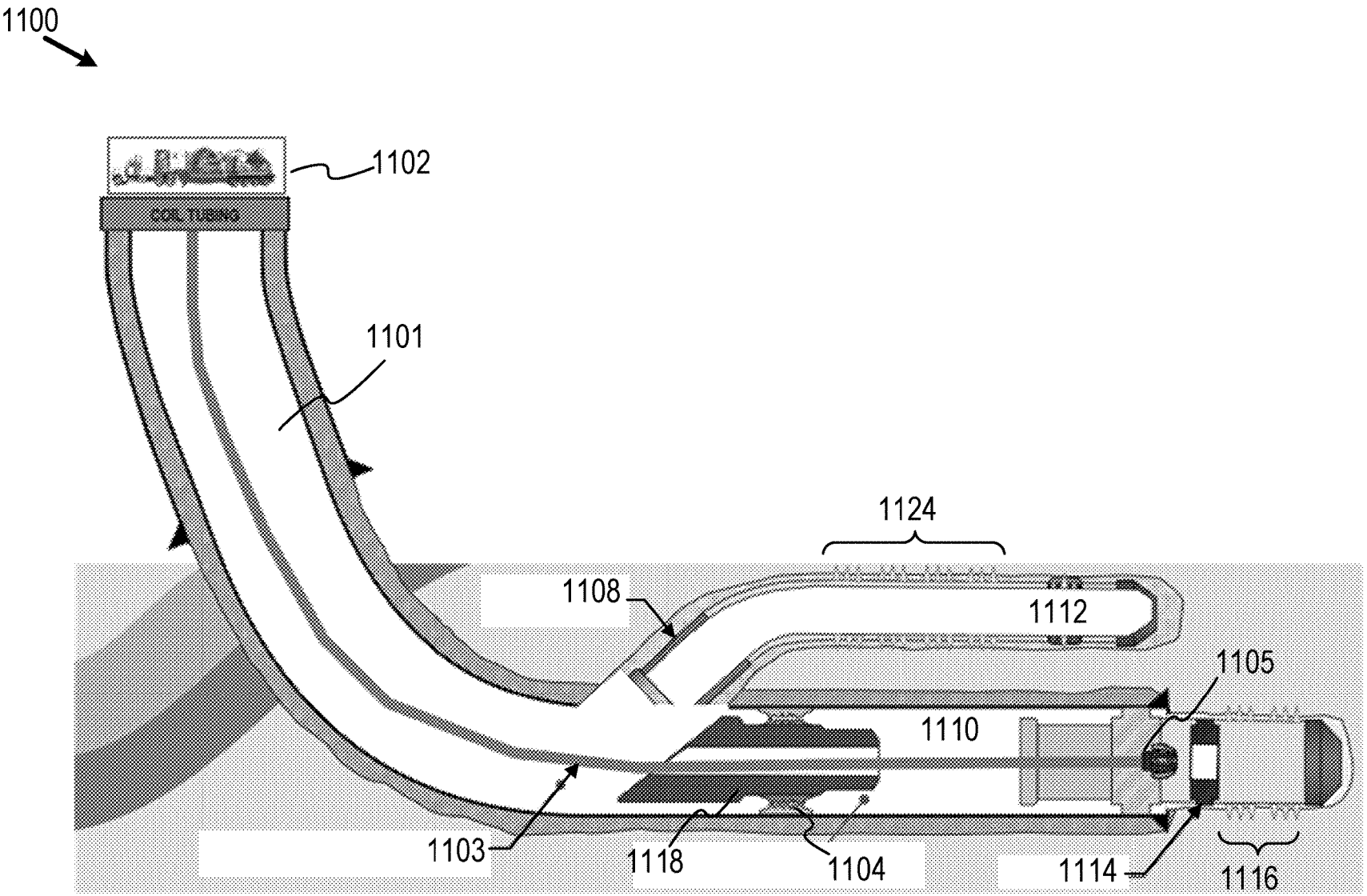
FIG. 11 is a ninth diagram of an example MLT well operation using the optimized technique, according to some implementations.

FIG. 11 is a ninth diagram 1100 of an example MLT well operation using the optimized technique, according to some implementations. The diagram 1100 includes a well 1101, a coiled tubing unit 1102, coiled tubing 1103, anchoring, orienting, and sealing device 1104, a milling BHA 1105, a liner 1108, a primary bore 1110, lateral bore 1112, primary bore barrier 1114, fractures 1116, main diverter 1118, and fractures 1124. In FIG. 11, the milling BHA 1105, having milled through the internal diverter in the primary bore 1110, may progress through the primary bore 1110 to mill out the primary bore barrier 1114. In some implementations, multiple primary bore barriers may be milled during this procedure. The milling BHA 1105 may then be retrieved through the main diverter 1118's ID and pulled back to the surface.

Figure 12:
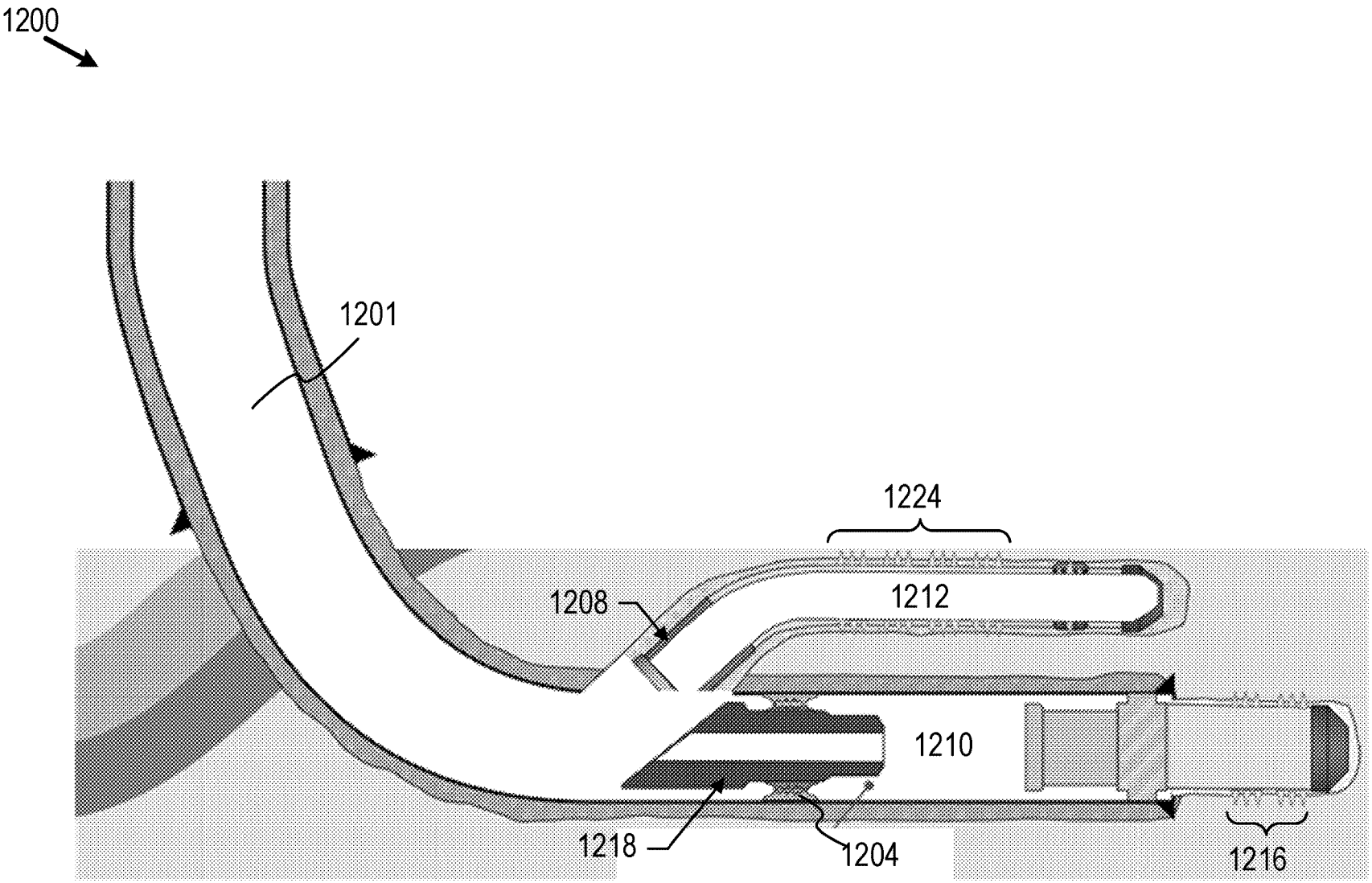
FIG. 12 is a tenth diagram of an example MLT well operation using the optimized technique, according to some implementations.

FIG. 12 is a tenth diagram 1200 of an example MLT well operation using the optimized technique, according to some implementations. The diagram 1200 includes a well 1201, an anchoring, orienting, and sealing device 1204, a liner 1208, a primary bore 1210, lateral bore 1212, fractures 1216, main diverter 1218, and fractures 1224. In FIG. 12, both the primary bore 1210 and lateral bore 1212 have been fractured and stimulated, all barriers have been milled out, and the well 1201 is ready for production.

As shown in FIGS. 3-12, the optimized technique may combine running frack strings and workover whipstocks (e.g., such as the main diverter and internal diverter) on a single trip into the well. The optimized technique may also combine the drilling of multiple isolation barriers/plugs and gaining access to lateral wellbores without needing to pull the milling BHA to the surface. The reduced number of trips may result in significant cost saving and less surface equipment mobilization. For example, one the frac string 606 has been removed from the well 606, a coiled tubing unit may be used for the remainder of the operations in FIGS. 8-12 to prepare the multilateral well for production. Because the main diverters are not pulled from their respective wellbores, there workover rig 702 may not be used for the operations of FIGS. 8-12. Well control issues within the multilateral well may also be mitigated by milling all plugs within a single trip. Other benefits via the optimized technique, such as reduced emissions and increased safety during operations, may be observed.

The internal diverter(s) depicted in FIGS. 5-9 may be replaced as needed. For example, an internal diverter may be installed into the main diverter 1218 after the original internal diverter has been milled. The new internal diverter, once installed and flush with the ramped face of the main diverter 1218, may allow access to the lateral bore 1212. The main diverter 1218 and new internal diverter may deflect a work string into the lateral bore 1212 to perform operations. The internal diverter may also prevent debris from falling into the primary bore 1210 while operations in the lateral bore 1212 are performed.

In some implementations, one or more of the primary bore barriers and lateral bore barriers may be pulled from the well rather than being milled. Multiple pulling tools may be installed on the bottom of each plug as well as the bottom of each internal diverter. The same pulling tool may be installed at the bottom of the coiled tubing BHA and used to retrieve the first lateral barrier. The first internal diverter may then be pulled using the pulling tool from the first barrier. Lateral barriers, such as lateral isolation plugs, may be pulled in a single trip. In some implementations, both one or more lateral barriers (e.g., a bridge plug(s)) and an internal diverter may be retrieved from the well in a single trip.

Example Trilateral Well Operations

The above operations are now described with reference to a trilateral well. Similar to FIGS. 1-2, some aspects of the trips may be described with certain assumptions. For example, processes used in both the conventional technique and optimized technique may not be counted as dedicated trips into/out of the trilateral well. The total number of trips discussed is intended to highlight the reduced trips into and out of the well that are achieved via the optimized technique.

FIG. 13 is an illustration 1300 depicting an example trip overview for a trilateral well using conventional techniques and equipment, according to some implementations. Similar to FIG. 1, a primary bore may be fracked and isolated via a frac unit and workover rig, respectively. During a first trip into the trilateral well, a workover whipstock may be run for lateral access via a workover rig. The workover rig may pull out of hole after installing the workover whipstock. On a second trip, the workover rig may be used to run a fracture (frac) work string for lower lateral stimulation. Frac equipment may be used to stimulate the lower lateral. A coiled tubing unit may be conveyed into the multibore well to isolate the lateral via an isolation barrier.

In the third trip, the workover rig may be used to pull the frac string from the lower lateral bore to the surface. A workover whipstock may be run from the surface into the well during a fourth dedicated trip to provide access to an upper lateral bore. The work string may then be pulled to the surface. The workover rig may run a frac string for upper lateral stimulation during a fifth trip. The upper lateral may be stimulated and the upper lateral may be isolated via a barrier conveyed into the upper lateral via coiled tubing. The workover rig may again be brought on site to pull the frac string from the upper lateral during a sixth trip. To ready the well for production, the workover rig may again be swapped for a coiled tubing unit. The coiled tubing unit may run a milling BHA into the upper lateral during a seventh dedicated trip. The milling BHA may be used to mill out one or more barriers in the upper lateral. The milling BHA is then pulled out of the well. Coiled tubing or the workover rig may be used to run a workover whipstock (WOW) retrieval tool into the trilateral well during an eighth trip. The workover whipstock may be engaged by the WOW retrieval tool and pulled out of the well to allow access to a lower lateral. During a ninth trip into the trilateral well, the milling BHA may be run into the lower lateral via coiled tubing to mill out isolation barriers in the lower lateral. The coiled tubing may be pulled from the lower lateral to the surface after milling the isolation barriers (e.g., bridge plugs). The coiled tubing unit or the workover rig may be used during a tenth dedicated trip into the well to run the WOW retrieval tool. The WOW retrieval tool may be used to engage a lower main diverter in the primary bore. The retrieval tool may be pulled from the well. During an eleventh trip, the milling BHA may be run into the primary bore via coiled tubing to mill out isolation barriers within the primary bore of the trilateral well. The coiled tubing and milling BHA may then be pulled out of hole (POOH). This conventional approach includes significant swapping of surface equipment (e.g., swapping the coiled tubing for the workover rig and vice versa, requiring the frac unit to arrive on site to stimulate each lateral etc.). This conventional approach includes 11 dedicated runs into the trilateral well-six of these trips are performed via the workover rig, and five trips are performed via a coiled tubing unit.

FIG. 14 is an illustration 1400 depicting an example trip overview for a trilateral well using optimized techniques and equipment, according to some implementations. In contrast to the above conventional approach, an optimized technique for stimulating multiple lateral bores in a trilateral well may utilize less dedicated runs into the well. As shown in FIG. 14, a wellbore treatment operation may be performed in the primary bore of a trilateral well. For example, the primary bore may be fracked and isolated using a workover rig and frac equipment. During a first trip, a lateral access diverter may be run on a frac string via the workover rig. The lateral access diverter (LAD), which may also be referred to as a diverter assembly, may be mounted within a lower lateral seal bore. The frac string may be diverted into the upper lateral via the LAD in the lower lateral. The frac string may be used to stimulate the upper lateral. A coiled tubing unit may be used to isolate the upper lateral after stimulation via one or more barriers. In a second dedicated trip, the frac string may be pulled from the well via the workover rig. In a third and final trip, the coiled tubing unit may be used to ready the trilateral well for production. In the third trip, a milling BHA may be run into the upper lateral bore on coiled tubing. The milling BHA may be used to mill out isolation barriers in the upper lateral bore. Without removing the milling BHA to the surface, the milling BHA may be pulled back into the primary bore of the trilateral well (Trip 3a). The milling BHA may be used to remove the internal diverter of a diverter assembly (LAD) positioned in the lower lateral. In some implementations, removing the internal diverter may include milling, although other procedures may be used. The milling BHA may be slid over a diverter in the primary bore and may be used to mill out the isolation barriers within the lower lateral bore (Trip 3b). Without removing the milling BHA to the surface, the milling BHA may be pulled into the primary bore once again and used to remove an internal diverter from the primary bore diverter assembly (Trip 3c). Lastly, the milling BHA may be used to remove the isolation barriers in the primary bore. In three dedicated trips into the well, the well may be prepared for production. This is eight fewer trips than the conventional approach of FIG. 13.

This optimized technique enables less equipment swapping at the surface and less runs overall—three dedicated runs are performed, where two are completed via a workover rig and one dedicated trip is performed using a coiled tubing unit. Running the diverter assembly (including the main diverter) into the well on the frac string and/or a JIT maximizes trip efficiency. Using the optimized technique, any number of isolation barriers in a multilateral well may be run, removed, and/or retrieved using standard coiled tubing equipment without pulling out of the well. Furthermore, the optimized technique reduces the need for swapping surface equipment between various operations. For example, the optimized technique may enable isolation barriers to be removed via a coiled tubing system without having to pull large/long assemblies that will require non-standard equipment on surface to swallow the BHA.

With reference to FIG. 14, the one dedicated trip using the coiled tubing may be used to remove any number of isolation barriers within any number of lateral bores within the multibore well. Using one trip to mill any barriers within the lateral bore(s) and barriers, restrictions, etc. within the primary bore may minimize well control issues, as all barriers and restrictions are removed within a single trip.

Example Method of Operations

Figure 15:
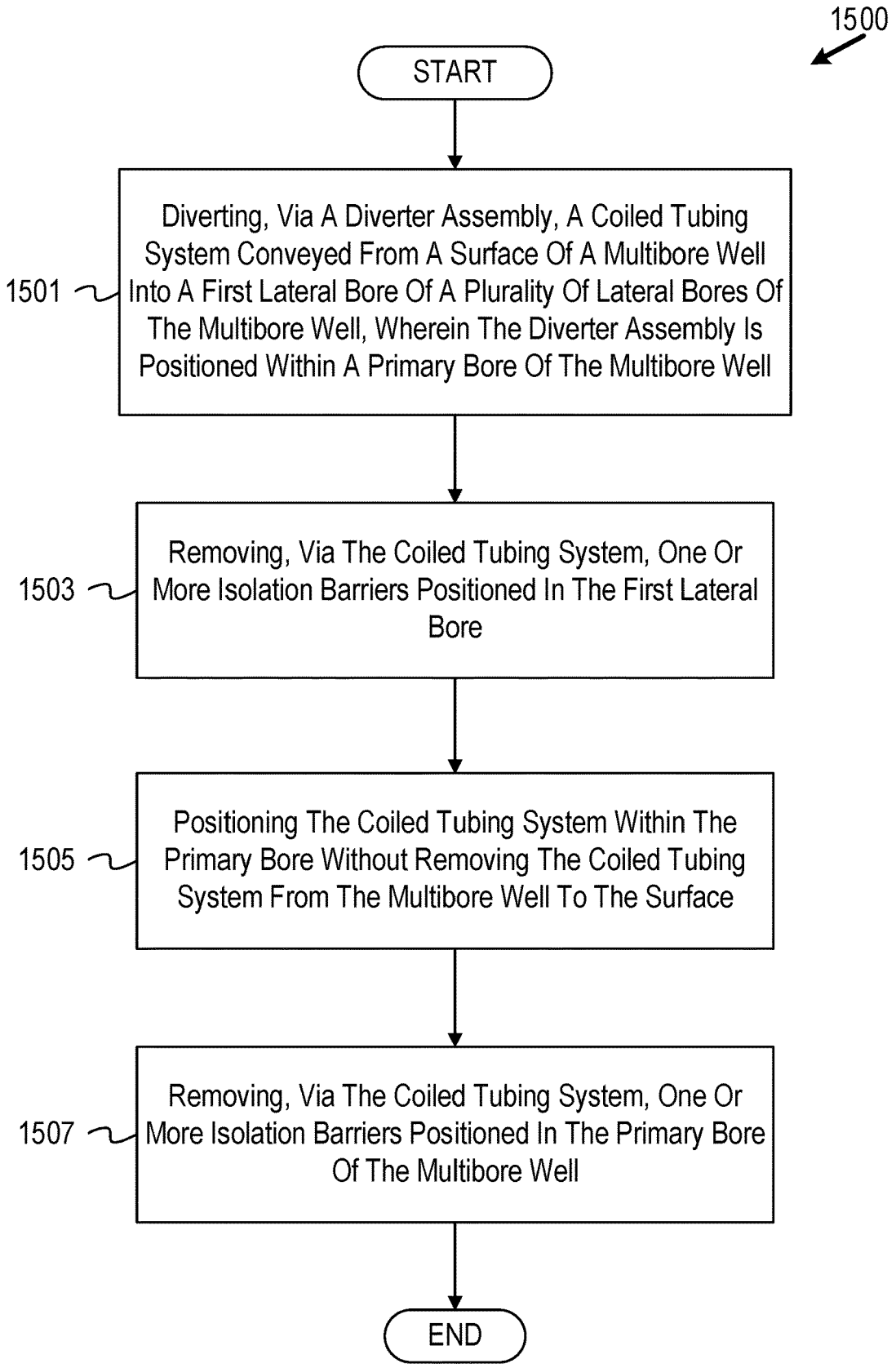
FIG. 15 is a flowchart depicting an example method of operations, according to some implementations.

FIG. 15 is a flowchart depicting an example method of operations, according to some implementations. Operations of a method 1500 may be performed in part by software, firmware, hardware, or a combination thereof. Such operations are described with reference to FIGS. 1-14. However, such operations may be performed by other systems or components. The operations of the method 1500 begin at block 1501.

At block 1501, the method 1500 includes diverting, via a first diverter assembly, a coiled tubing system conveyed from a surface of a multibore well into a first lateral bore of a plurality of lateral bores of the multibore well, wherein the first diverter assembly is positioned within a primary bore of the multibore well. For example, the main diverter 518 and the internal diverter 520 may comprise a diverter assembly. The diverter assembly may be conveyed from a surface of the well 501 (e.g., a multilateral well) using a fracture work string such as the frac string 506. The frac string 506 and diverter assembly may be conveyed into the well during a single trip via a workover rig. The diverter assembly may be landed into the primary bore 510 via the anchoring, orienting, and sealing device 504. The diverter assembly may be mounted/secured in the primary bore 510 via the anchoring, orienting, and scaling device 504. In some implementations, the main diverter 518 may include a sleeve extending into the junction between the primary bore 510 and a lateral bore 512. The sleeve may mitigate the top of the liner 508, at least a portion of the subsurface formation, etc. from falling into the primary bore 510 without necessitating additional tools and/or trips from the surface.

With reference to FIG. 6, a coiled tubing system may be diverted into the lateral bore 612 to set an isolation plug. For example, the frac string 606 and seal stinger 622 may be conveyed into the well 601 via a coiled tubing system (or other tubular system) with the lateral isolation barrier 626. The frac string 606 and seal stinger 622 may then be used to set the lateral isolation barrier 626 within the lateral bore 612. Additional diverter assemblies may be positioned in additional lateral bores in multibore wells. The additional diverter assemblies may be used to access additional lateral bores further from the primary bore 610. For example, a second, upper lateral bore in a trilateral well may be fracked, and an isolation plug may be set by a coiled tubing system. Flow progresses to block 1503.

At block 1503, the method 1500 includes removing, via the coiled tubing system, one or more isolation barriers positioned in the first lateral bore. For example, with reference to FIG. 8, some implementations may utilize a removal tool such as the milling BHA 805 to remove the lateral isolation barrier(s) 826, from the lateral bore 812. In some implementations, the one or more isolation barriers in the lateral bore 812 may be removed by other means. For example, the lateral isolation barrier(s) 826 may instead be removed via a drilling, via dissolving, etc. Some implementations of the removal tool may include a system configured to retrieve the lateral isolation barrier(s) 826 from the well. Flow progresses to block 1505.

At block 1505, the method 1500 includes positioning the coiled tubing system within the primary bore without removing the coiled tubing system from the multibore well to the surface. For example, the milling BHA 1005, run into the well 1001 via the coiled tubing 1003, may be positioned within the primary bore 1010 after removing the internal diverter of the diverter assembly. The coiled tubing 1003 and milling BHA 1005 may be positioned within the primary bore 1010 after removing the isolation barriers within the lateral bore 1012 without removing the coiled tubing 1003 and milling BHA 1005 from the well 1001 to the surface.

With reference to FIG. 9, the milling BHA 905 may be used to remove the internal diverter 920 and pass through the main diverter 918. In some implementations, the internal diverter 920 may be comprised of a mill-able material, a drillable material, a dissolvable material, etc. However, some implementations may also use a removal tool to retrieve the internal diverter 920, where the internal diverter 920 is brought to the surface intact. Flow progresses to block 1507.

At block 1507, the method 1500 includes removing, via the coiled tubing system, one or more isolation barriers positioned in the primary bore of the multibore well. For example, the milling BHA 1105 may be conveyed into the primary bore 1110 and used to remove the primary bore isolation barrier 1114. In some implementations, the primary bore isolation barrier(s) may be removed by similar means to the lateral isolation barrier(s) of block 1503. For example, the primary bore isolation barrier(s) 1114 may be removed via milling, drilling, etc. Some implementations may instead retrieve the primary bore isolation barrier(s) 1114 from the well-however, this may include an additional trip. Flow of the method 1500 ceases.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

While operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the terms "subsurface formation" or "subterranean formation" shall be construed as encompassing both areas below exposed earth and areas below earth covered by water such as ocean or fresh water.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed. As used herein, a phrase referring to "at least one of" a list of items refers to any combination of those items, including single members. As an example, "at least one of: a, b, or c" is intended to cover: a, b, c, a-b, a-c, b-c, and a-b-c.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE IMPLEMENTATIONS

Implementation #1: A method comprising: diverting, via a first diverter assembly, a coiled tubing system conveyed from a surface of a multibore well into a first lateral bore of a plurality of lateral bores of the multibore well, wherein the first diverter assembly is positioned within a primary bore of the multibore well; removing, via the coiled tubing system, one or more isolation barriers positioned in the first lateral bore; positioning the coiled tubing system within the primary bore without removing the coiled tubing system from the multibore well to the surface; and removing, via the coiled tubing system, one or more isolation barriers positioned in the primary bore of the multibore well.

Implementation #2: The method of Implementation 1, further comprising: positioning, via a fracture string, the first diverter assembly within the primary bore of the multibore well, the first diverter assembly including an external diverter and a first internal diverter, wherein positioning the first diverter assembly within the primary bore of the multibore well plugs and fluidically isolates the primary bore.

Implementation #3: The method of any one or more of Implementations 1-2, further comprising: positioning, via the fracture string, a second diverter assembly within the first lateral bore of the multibore well; and diverting, via the second diverter assembly, the fracture string into a second lateral bore of the multibore well.

Implementation #4: The method of any one or more of Implementations 1-3, further comprising: removing the first internal diverter; and removing the one or more isolation barriers in the primary bore after the removing of the first internal diverter.

Implementation #5: The method of any one or more of Implementations 1-4, wherein removing the first internal diverter comprises milling the first internal diverter.

Implementation #6: The method of any one or more of Implementations 1-5, wherein removing the first internal diverter comprises dissolving the first internal diverter, wherein the first internal diverter is comprised of a dissolvable material.

Implementation #7: The method of any one or more of Implementations 1-6, wherein removing the first internal diverter comprises retrieving the first internal diverter from the multibore well.

Implementation #8: The method of any one or more of Implementations 1-7, further comprising: orienting, via an external orienting device including an orienting feature, a second internal diverter for placement within the external diverter after the first internal diverter has been removed; and installing the second internal diverter within the external diverter.

Implementation #9: The method of any one or more of Implementations 1-8, wherein the removing of the one or more isolation barriers positioned in the first lateral bore and removing the one or more isolation barriers positioned in the primary bore includes at least one of milling, drilling, and retrieving the one or more isolation barriers.

Implementation #10: The method of any one or more of Implementations 1-9, further comprising: securing the first diverter assembly in the primary bore via an anchoring, orienting, and sealing device positioned within the primary bore.

Implementation #11: A system comprising: a fracture string including one or more pipes to be lowered from a surface into a multibore well formed in one or more subsurface formations; and a diverter assembly to be run into the multibore well with the fracture string and configured for placement within a primary bore of the multibore well, the diverter assembly comprising, an external diverter positioned within the primary bore of the multibore well, and an internal diverter positioned within an opening of the external diverter, wherein the external diverter and internal diverter are configured to divert one or more downhole tools into a lateral bore of the multibore well.

Implementation #12: The system of Implementation 11, wherein the internal diverter is comprised of at least one of a drillable material and a mill-able material.

Implementation #13: The system of any one or more of Implementations 11-12, wherein the internal diverter is comprised of a dissolvable material.

Implementation #14: The system of any one or more of Implementations 11-13, further comprising: an anchoring, orienting, and sealing device to be positioned within at least the primary bore of the multibore well, wherein the anchoring, orienting, and sealing device is configured to secure the external diverter within the primary bore of the multibore well.

Implementation #15: The system of any one or more of Implementations 11-14, further comprising: a first isolation barrier positioned within the primary bore of the multibore well; and at least a second isolation barrier positioned within at least the lateral bore of the multibore well, wherein the first isolation barrier and at least the second isolation barrier are removable from the multibore well in a single trip of a removal tool without removing the removal tool from the multibore well to the surface.

Implementation #16: The system of any one or more of Implementations 11-15, wherein the first isolation barrier and the second isolation barrier are removable by means of at least one of drilling, milling, and retrieval.

Implementation #17: An apparatus comprising: a diverter assembly to be lowered from a surface into a multibore well with a fracture string and configured for placement within at least a primary bore of the multibore well, the diverter assembly comprising, an external diverter positioned within the primary bore of the multibore well, and an internal diverter positioned within an opening of the external diverter, wherein the external diverter and internal diverter are configured to divert one or more downhole tools into a lateral bore of the multibore well.

Implementation #18: The apparatus of Implementation 17, wherein the internal diverter is comprised of at least one of a drillable material and a mill-able material.

Implementation #19: The apparatus of any one or more of Implementations 17-18, wherein the internal diverter is comprised of a dissolvable material.

Implementation #20: The apparatus of any one or more of Implementations 17-19, further comprising: an anchoring, orienting, and sealing device to be positioned within at least the primary bore of the multibore well, wherein the anchoring, orienting, and sealing device is configured to secure the external diverter within the primary bore of the multibore well.

What is claimed is:

1. A system comprising:

a fracture string configured to stimulate at least one bore of a multibore well formed in one or more subsurface formations, wherein the fracture string is configured for conveyance from a surface into the multibore well; and a diverter assembly configured for conveyance into the multibore well with the fracture string, wherein the diverter assembly is configured for placement within a primary bore of the multibore well, the diverter assembly comprising, an external diverter to be positioned within the primary bore, and an internal diverter positioned within an opening of the external diverter, wherein the external diverter and internal diverter are configured to divert one or more downhole tools into a lateral bore of the multibore well.

2. The system of claim 1, wherein the internal diverter is comprised of at least one of a drillable material or a mill-able material.

3. The system of claim 1, wherein the internal diverter is comprised of a dissolvable material.

4. The system of claim 1, further comprising:

a landing device installed within a tubular positioned in at least the primary bore of the multibore well, wherein the landing device includes a latching profile configured to secure the external diverter within the primary bore of the multibore well, and wherein the diverter assembly is configured to selectively couple to the fracture string during the conveyance into the multibore well.

5. The system of claim 4, wherein the landing device is configured to anchor the diverter assembly within the primary bore, orient the diverter assembly during installation, and provide an annular pressure seal between the diverter assembly and an inner diameter of the tubular.

6. The system of claim 1, further comprising:

a first isolation barrier positioned within the primary bore of the multibore well; and at least a second isolation barrier positioned within at least the lateral bore of the multibore well, wherein the first isolation barrier and at least the second isolation barrier are removable from the multibore well in a single trip of a removal tool without removing the removal tool from the multibore well to the surface.

7. The system of claim 6, wherein the first isolation barrier and the second isolation barrier are removable by means of at least one of drilling, milling, or retrieval.

8. An apparatus comprising:

a diverter assembly configured for conveyance from a surface into a multibore well with a fracture string, wherein the fracture string is configured to stimulate at least one bore of the multibore well, and wherein the diverter assembly is configured for placement within at least a primary bore of the multibore well, the diverter assembly comprising, an external diverter to be positioned within the primary bore, and an internal diverter positioned within an opening of the external diverter, wherein the external diverter and internal diverter are configured to divert one or more downhole tools into a lateral bore of the multibore well.

9. The apparatus of claim 8, wherein the internal diverter is comprised of at least one of a drillable material or a mill-able material.

10. The apparatus of claim 8, wherein the internal diverter is comprised of a dissolvable material.

11. The apparatus of claim 8, further comprising:

a landing device installed within a tubular positioned in at least the primary bore of the multibore well, wherein the landing device includes a latching profile configured to secure the external diverter within the primary bore of the multibore well, and wherein the diverter assembly is configured to selectively couple to the fracture string during the conveyance into the multibore well.

12. The apparatus of claim 11, wherein the landing device is configured to anchor the diverter assembly within the primary bore, orient the diverter assembly during installation, and provide an annular pressure seal between the diverter assembly and an inner diameter of the tubular.

13. A method comprising:

configuring a fracture string to couple with a diverter assembly prior to conveyance into a multibore well formed in one or more subsurface formations, wherein the fracture string is configured to stimulate at least one bore of the multibore well;

conveying the fracture string and the diverter assembly into the multibore well during a single trip; and positioning the diverter assembly within a primary bore of the multibore well, wherein the diverter assembly includes an external diverter and an internal diverter positioned within an opening of the external diverter, and wherein the external diverter and internal diverter are configured to divert one or more downhole tools into a lateral bore of the multibore well.

14. The method of claim 13, further comprising:

decoupling the frac string from the diverter assembly in the primary bore;

pulling the frac string uphole without removing the frac string from the multibore well;

diverting, via the diverter assembly, the frac string into the lateral bore of the multibore well; and stimulating, via the frac string, the lateral bore in the single trip.

15. The method of claim 13, further comprising:

positioning, after stimulating the lateral bore and during the single trip, an isolation barrier within the lateral bore; and removing, after positioning the isolation barrier within the lateral bore, the frac string from the multibore well.

16. The method of claim 13, further comprising:

removing the internal diverter from the external diverter, wherein removing the internal diverter comprises drilling the internal diverter, milling the internal diverter, dissolving the internal diverter, or retrieving the internal diverter.

17. The method of claim 13, further comprising:

seating the diverter assembly in a landing device installed within a tubular positioned within at least the primary bore of the multibore well, wherein the landing device includes a latching profile configured to secure the external diverter within the primary bore of the multibore well, and wherein the diverter assembly is configured to selectively couple to the fracture string during the conveying into the multibore well.

18. The method of claim 17, wherein the landing device is configured to anchor the diverter assembly within the primary bore, orient the diverter assembly during installation, and provide an annular pressure seal between the diverter assembly and an inner diameter of the tubular.

* * * * *